US007263803B2

(12) United States Patent
Herwich et al.

(10) Patent No.: US 7,263,803 B2
(45) Date of Patent: Sep. 4, 2007

(54) VEHICLE BARRIER

(75) Inventors: Ingo Herwich, Vienna (AT); Erich Kranzinger, Strasswalchen (AT); Gregor Ponert, Salzburg (AT)

(73) Assignee: Skidata AG, Gartenau (AT)

( * ) Notice: Subject to any disclaimer, the term of this patent is extended or adjusted under 35 U.S.C. 154(b) by 274 days.

(21) Appl. No.: 11/014,634

(22) Filed: Dec. 16, 2004

(65) Prior Publication Data

US 2005/0150165 A1 Jul. 14, 2005

(51) Int. Cl.
*E05B 65/10* (2006.01)

(52) U.S. Cl. ..... 49/49

(58) Field of Classification Search ..... 49/49, 49/35; 404/6, 9, 10
See application file for complete search history.

(56) References Cited

U.S. PATENT DOCUMENTS

| | | | | |
|---|---|---|---|---|
| 4,364,200 | A | 12/1982 | Cobb | |
| 4,844,653 | A | 7/1989 | Dickinson | |
| 5,813,796 | A | 9/1998 | Kocznar | |
| 6,370,821 | B1 | 4/2002 | McCord et al. | |
| 6,470,626 | B2 | 10/2002 | Luetzow et al. | |
| 6,618,993 | B2 * | 9/2003 | Burke | 49/49 |
| 6,672,008 | B1 | 1/2004 | Luetzow et al. | |
| 6,997,417 | B2 * | 2/2006 | Zarkades | 246/125 |
| 7,065,923 | B2 * | 6/2006 | Parsadayan et al. | 49/141 |
| 2002/0152682 | A1 * | 10/2002 | Parsadayan et al. | 49/49 |
| 2003/0029089 | A1 * | 2/2003 | Wenzl et al. | 49/49 |

FOREIGN PATENT DOCUMENTS

| | | |
|---|---|---|
| DE | 1 907 056 U | 12/1964 |
| DE | 1 755 548 A1 | 9/1971 |
| DE | 30 15 284 C2 | 1/1982 |
| DE | 92 12 297 U1 | 12/1992 |
| EP | 0 937 821 A2 | 8/1999 |
| FR | 2 768 447 A1 | 3/1999 |
| WO | WO 03/027398 A1 | 4/2003 |

OTHER PUBLICATIONS

Search Report dated Mar. 18, 2005 in EP Application No. 04 02 9527 (1 page).

* cited by examiner

*Primary Examiner*—Jerry Redman
(74) *Attorney, Agent, or Firm*—Flynn, Thiel, Boutell & Tanis, P.C.

(57) ABSTRACT

A barrier is formed such that its barrier arm automatically moves back to its blocking position after forceful opening of the barrier.The barrier arm is pivotally mounted to a barrier post about a horizontal axis. The barrier post is formed to include a swivel joint having a vertical axis around which the barrier arm swivels upon forceful opening.

12 Claims, 1 Drawing Sheet

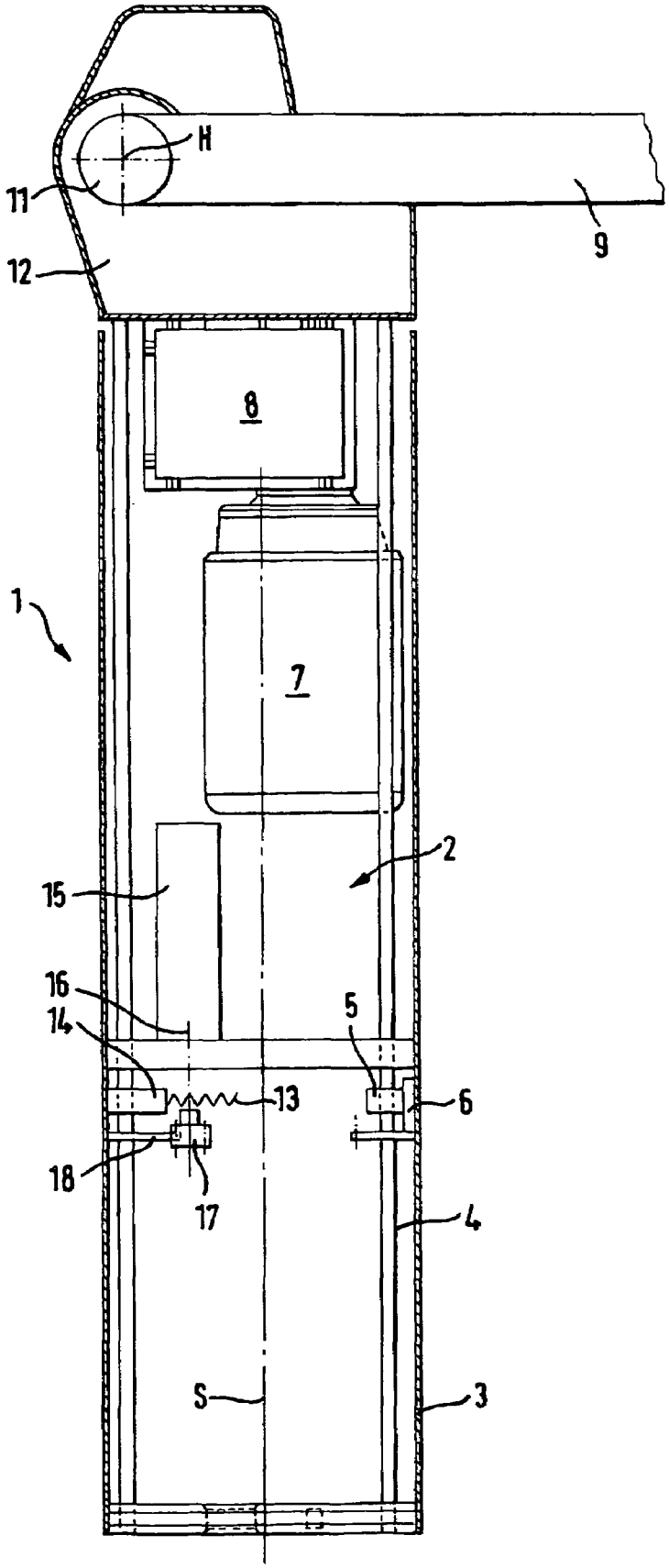
H
11
9
12
8
1
7
2
15
16
5
14
13
6
18
17
4
S
3

VEHICLE BARRIER

FIELD OF THE INVENTION

This invention relates to a barrier having a barrier post and a drive for swiveling the barrier arm around a horizontal axis between the blocking and open positions and a swivel joint having a vertical axis around which the barrier arm swivels upon forceful opening. in accordance with the preamble of claim 1.

BACKGROUND OF THE INVENTION

Such barriers are used primarily as vehicle barriers, in particular as parking lot barriers for controlling the entrance to and exit from parking areas.

To prevent damage, or at least excessive damage, to a vehicle that moves against the barrier arm in the blocking position, parking lot barriers have a rated breaking point in the barrier arm.

However, hours and days often pass before the broken barrier arm is repaired, especially in unmanned parking facilities where the break of the barrier arm is frequently noticed quite late.

Since following vehicles can pass a broken parking lot barrier without paying, considerable losses result for the operator. In car parks where data carriers are used for actuating the barrier, further costs arise from the loss of the data carriers, particularly in the case of costly data carriers such as cards or coins provided with chips, transponders and similar electronic devices.

A broken barrier arm also means that control over the occupancy of the parking facility is lost. Furthermore, drivers can go in the wrong direction so that if a barrier has broken at the exit, for example, the exit can also be used as an entrance. If the entrance barrier is broken, the staff can moreover attempt fraud by collecting from exiting vehicles at the exit barrier. Apart from that, when the barrier arm of a parking lot barrier is broken, an attendance effort often lasting hours is required until all vehicles that have entered via the exit or entrance without any parking authorization have left the parking facility again.

U.S. Pat. No. 6,470,626 discloses a barrier of the type stated at the outset. An arm is pivoted on each side of the barrier arm to swing around the horizontal axis and form a mount for the barrier arm swinging around a vertical axis upon forceful opening. The known barrier has a complicated structure.

The problem of the invention is to form a conventional barrier with modifications as slight as possible such that its function is not affected when it is opened forcefully by a vehicle or in another way.

This is obtained by the barrier according to the invention.

SUMMARY OF THE INVENTION

According to the invention, the barrier is formed so that when the barrier arm is in the blocking position and is forcefully opened by a vehicle or in another way, e.g. by a person, it moves back to its blocking position automatically, for example by a corresponding drive.

In the inventive barrier the barrier arm is thus not destroyed upon forceful opening. This prevents following vehicles from being able to pass the barrier without authorization after forceful opening of the barrier. Moreover, the inventive barrier can be opened even when the drive for opening the barrier is inoperable, for example. The blocking position refers here not only to the position in which the barrier arm is completely closed but to any position in which the passage of a vehicle is prevented.

To permit the barrier arm to be opened forcefully without destruction in the blocking position and moved back to the blocking position automatically after forceful opening, a swivel joint is provided around which the barrier arm is swiveled upon forceful opening and upon moving back to the blocking position.

The swivel joint can be provided on the barrier arm, preferably adjacent to the swivel axis of the barrier arm around which it swivels on the barrier post for opening and closing the barrier. The swivel joint can also be located on the barrier post, however.

The swivel joint usually has a vertical swivel axis so that it can give way sideways when a vehicle moves against the barrier arm. The swivel joint is preferably formed so that the barrier arm can give way sideways both in the direction of travel and in the opposite direction. This prevents e.g. a vehicle that has duly passed the exit barrier from destroying the closed barrier arm when moving backwards, for example running back from an exit ramp after the exit barrier, that is, in the opposite direction.

Furthermore, a further swivel joint having a horizontal swivel axis can be provided so that the barrier arm can also give way upwardly and/or downwardly. A person can thus be prevented from trying to destroy the barrier arm by forcefully pressing it upward and/or downward so that it cannot return to the blocking position. That is, the inventive barrier is preferably formed so that the barrier arm is formed to give way sideways and upwardly for protection against forceful opening.

For forcefully opening the inventive barrier with the barrier arm in the blocking position, a given force must be overcome. This force can be given by corresponding regulations. Thus, a conventional barrier arm with rated breaking points is to break according to the relevant standards for example when acted upon by a 20 kg force. Accordingly, in the inventive barrier the barrier arm is only moved out of its blocking position when acted upon by a force of e.g. 10 to 50 kg upon forceful opening.

The swivel joint for forcefully opening the barrier arm and moving it back to the blocking position can be formed for example by the barrier post to which the barrier arm for opening and closing is pivoted consisting of two mutually rotatable members, the barrier arm for opening and closing the barrier being pivoted to one member while the other member forms the base for supporting the barrier post on the ground and fastening it to the ground.

The member to which the barrier arm for opening and closing the barrier is pivoted can be formed by the barrier post of a conventional, commercially available barrier. The barrier post of the conventional barrier need only be mounted to rotate relative to the other member forming the base of the inventive barrier around an axis extending in the longitudinal direction of the barrier post, i.e. a vertical axis. This permits a conventional barrier with motor and transmission in the barrier post to be used for building the inventive barrier practically without any change.

When a conventional, commercially available barrier has a barrier post whose housing is of tubular or cylindrical form at least in the lower area, the barrier post of the conventional barrier can be disposed as an internal member within an external member with a corresponding inside recess, for example a tube, and be mounted to rotate relative to the external member e.g. with a roll body bearing.

To produce the force that must be overcome to forcefully open the barrier arm, a spring can be provided which is disposed for example in the internal member, i.e. the barrier post of the conventional barrier, and urges outwardly against a locking member formed e.g. by a ball, roller or similar roll body and engaging a receiving means in the external member forming the base. The force to be overcome for forcefully opening the barrier arm is then constituted by the force necessary for the spring loaded locking member to be disengaged, i.e. moved out of the receiving means.

The inventive barrier can be abused if for example a person deliberately opens the barrier arm by force, i.e. by overcoming said given force. However, the possibility of abuse is no greater than with the known barrier with a rated breaking point, while the inventive barrier does not have the above-described disadvantages of the known barrier in the case of abuse.

Moreover, abuse can be counteracted in the same way with the inventive barrier as with the conventional barrier, e.g. by video surveillance or the like.

To prevent the barrier arm from moving back after forceful opening by a vehicle while the vehicle is still located in the swivel range of the barrier arm, a device for detecting a vehicle in the moving range of the barrier arm is preferably provided, which can optionally also detect a person. Said device can have video image processing means or a light barrier, an ultrasonic sensor, an induction loop or the like. A time measuring device can also be provided for moving back the barrier arm only after a given period of time after forceful opening. This period of time can be adjustable. The time measuring device can be activated for example by a control and safety device, e.g. an image processing device.

The barrier arm of the inventive barrier can be formed as a rigid tube. The inventive barrier can likewise be an articulated barrier, i.e. a barrier arm with at least one joint swiveling around a horizontal axis, as used for example in parking spaces of low height. It is further advantageous to make the barrier arm illuminable.

For automatically moving back the barrier arm to the blocking position after forceful opening, a drive can be provided. For example, a spring, a motor, a pneumatic or hydraulic drive can be provided for automatically moving back the barrier arm after forceful opening.

Numerous other embodiments are conceivable for permitting the barrier arm to be forcefully opened without destruction and automatically moved back to its blocking position. Thus the drive for moving back the barrier arm to the blocking position after forceful opening of the barrier can be formed by a material with a memory effect which resumes its original form after deformation.

BRIEF DESCRIPTION OF THE DRAWING

Hereinafter an embodiment of the invention will be described more precisely by way of example with reference to the drawing, whose single FIGURE shows a barrier with a longitudinally sectional barrier post and partly shown barrier arm.

DETAILED DESCRIPTION OF THE INVENTION

The barrier has a barrier post 1 consisting of two members, namely an internal member 2 and an external member 3 forming an external tube, which are mounted to rotate mutually around a vertical axis S which at the same time forms the longitudinal axis of the barrier post 1. The internal member 2 has an internal tube 4 as a housing. For mounting the internal tube 4 a radial bearing with roll bodies 5 is provided which roll on a raceway 6 on the inside wall of the external tube 3.

The external tube 3 forms the base for supporting the barrier post 1 on the ground and fastening it to the ground. The internal member 2 is formed by the barrier post of a conventional barrier. That is, the internal tube 4 constitutes the housing of the barrier post of the conventional barrier, whereby the internal tube 4 or housing contains the motor 7 and the transmission 8 for driving the barrier arm 9 to swivel it around a horizontal axis between the shown position in which the barrier arm 9 is swiveled downward and the open position in which the barrier arm 9 is swiveled upward. The barrier arm 9 is for this purpose fastened to a shaft 11 disposed on the head 12 of the internal member 2 and driven by the motor 7 via the transmission 8 for swiveling the barrier arm 9 around the horizontal axis H.

The pivot mounting of the internal tube 4 within the external tube 3 around the vertical axis S causes the barrier arm 9 to be swiveled out of the blocking position shown in the drawing, sideways, i.e. out of the road in the direction of travel, if a vehicle runs into it. So that the barrier arm 9 is swiveled sideways in the blocking position only if a vehicle runs into it or in case of another action of force, a device is provided for producing a given force which must be overcome upon forceful opening of the closed barrier arm 9.

For this purpose a radially displaceable member 14 loaded outwardly with a spring 13 and formed e.g. as a roll body is provided in the internal tube 4 to engage a recess (not shown) in the raceway 6 on the external tube 3. When a given force acts on the barrier arm 9 in the direction of travel through a vehicle, the locking member 14 is disengaged from the recess contrary to the force of the spring 13, so that the internal tube 4 can be rotated relative to the external tube 3 and thus the barrier arm 9 swiveled sideways.

To swivel the barrier arm 9 back to its blocking position shown in the drawing after sideways swivel through forceful opening, a motor 15 is provided in the internal tube 4, having a gearwheel 17 seated on the motor shaft 16 to mesh with a toothed ring 18 fastened to the inside of the external tube 3.

The invention claimed is:

1. A barrier having a barrier post and a first drive swiveling a barrier arm around a horizontal axis between blocking and open positions, a swivel joint having a vertical axis around which said barrier arm swivels upon forceful opening, a device for producing a given force to be overcome upon forceful opening of said barrier arm, and a second drive automatically moving said barrier arm back to an initial blocking position about said vertical axis, wherein said barrier post comprises at least two members mutually rotatable around the vertical axis for forming said swivel joint, the barrier arm being pivoted to a first of said at least two members and a second of said at least two members forming a base for anchoring said barrier post to a support.

2. A barrier according to claim 1, wherein said at least two members are formed of telescoped tubes of different diameter.

3. A barrier according to claim 1, wherein said first drive is fastened to said first member.

4. A barrier according to claim 3, wherein said first member comprises an internal tube.

5. A barrier according to claim 1, wherein said second drive is formed by one of a spring, a motor, a pneumatic device and a hydraulic device.

6. A barrier according to claim 1, wherein said device for producing a given force to be overcome upon forceful opening of said barrier arm comprises a spring.

7. A barrier according to claim 6, wherein said spring loads a locking member disposed in said first member in a direction toward said second member, said second member being provided with a receiving means for said locking member.

8. A barrier according to claim 1, further comprising a device for detecting obstructions, preventing said second drive from moving said barrier arm back to said initial position upon detection of an obstruction in a moving range of said barrier arm.

9. A vehicle barrier comprising:

a barrier post and a barrier arm supported on said barrier post so as to be pivotable vertically about a horizontal pivot axis between a lowered blocking position and a raised open position to control passage of vehicles, said barrier post further comprising a swivel joint connected with said barrier arm such that said barrier arm is rotatable sidewardly about a vertical swivel axis from said blocking position to a forcefully opened position in response to sideward forcing of said barrier arm, said barrier post comprising at least first and second post members which are relatively rotatable about said vertical swivel axis to define said swivel joint, said first post member being provided for anchoring said barrier post on a support surface and said second post member being rotatable relative to said first post member about said vertical swivel axis, and said barrier arm being supported by said second post member to permit said vertical pivoting about said horizontal pivot axis and to permit said sideward swiveling about said vertical swivel axis;

a swivel resisting device which resists said sideward swiveling of said barrier arm and defines a given force to be overcome upon forceful opening of said barrier arm about said vertical swivel axis;

a first drive pivoting said barrier arm around said horizontal axis between said blocking and open positions to control passage of vehicles; and a second drive automatically swiveling said barrier arm about said vertical axis back to said blocking position after forceful opening of said barrier arm.

10. The vehicle barrier according to claim 9, wherein said first post member and said second post member comprise telescoped tubes of different diameter.

11. The vehicle barrier according to claim 9, wherein said second drive comprises one of a spring, a motor, a pneumatic device and a hydraulic device.

12. The vehicle barrier according to claim 9, further comprising a device for detecting obstructions and preventing said second drive from moving said barrier arm back to said lowered blocking position upon detection of an obstruction.

* * * * *